US006390332B2

(12) United States Patent
Wakayama

(10) Patent No.: US 6,390,332 B2
(45) Date of Patent: May 21, 2002

(54) LIQUID CONTAINER

(75) Inventor: Takahiro Wakayama, Ibaraki-ken (JP)

(73) Assignee: Riso Kagayu Corporation, Tokyo (JP)

( * ) Notice: Subject to any disclaimer, the term of this patent is extended or adjusted under 35 U.S.C. 154(b) by 0 days.

(21) Appl. No.: 09/757,534

(22) Filed: Jan. 11, 2001

(30) Foreign Application Priority Data

Jan. 24, 2000 (JP) ..... 2000-014327

(51) Int. Cl.[7] ..... B65D 35/56
(52) U.S. Cl. ..... 222/105; 222/95; 222/386.5
(58) Field of Search ..... 222/95, 105, 386.5

(56) References Cited

U.S. PATENT DOCUMENTS 3,275,193 A * 9/1966 Barr ..... 222/1
3,895,746 A * 7/1975 Bauer ..... 222/386.5
4,129,025 A * 12/1978 Carey et al. ..... 72/348
5,312,018 A * 5/1994 Evezich ..... 222/95

* cited by examiner

*Primary Examiner*—Henry C. Yuen
*Assistant Examiner*—Melvin A. Cartagena
(74) *Attorney, Agent, or Firm*—Fitch, Even, Tabin & Flannery

(57) ABSTRACT

A liquid container is provided, which comprises a container body provided as an elongated flexible bag having a closed end face at an end thereof, a pouring outlet formed at the closed end face of the container body, and a support means for preventing deformation of a side face of the container body in its front portion adjacent to the closed end face, whereby a rear portion of the container body which is not reinforced by the support means is housed into the front portion as the contained liquid is discharged, in which the liquid container further comprises a stopper which is disposed on the side face of the rear portion of the container body for engaging with the front portion of the container body, whereby after the stopper has been engaged with the front portion, portion of the rear portion in front of the stopper is prevented from being further housed into the front portion. The liquid container allows the length of the container after use to be reduced to less than one half the length before use, and furthermore even in the case where the length of the container body is long, allows the rear portion to be well housed in the front portion, for stably allowing the contained liquid to be taken out.

6 Claims, 2 Drawing Sheets

LIQUID CONTAINER

Figure 1:
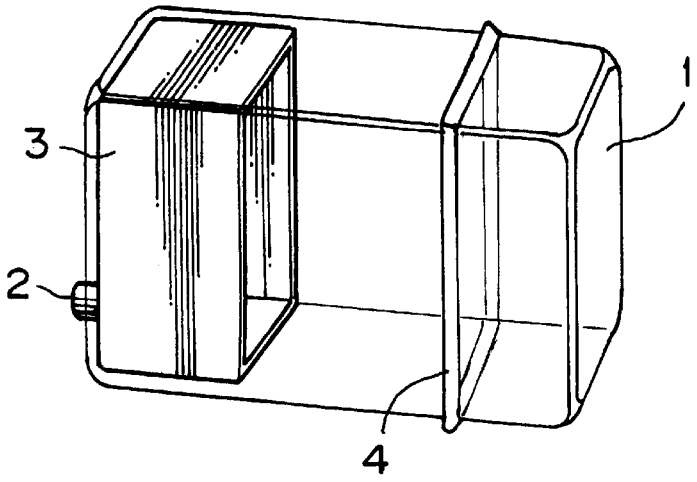

This invention relates to a container provided as a flexible bag suitable for containing a liquid, especially a liquid having a relatively high viscosity or a liquid sensitive to the contact with air.

Containers for packaging a liquid called bag-in boxes or bag-in cartons (hereinafter generally called "bag-in cartons") in which a flexible bag with a pouring outlet is contained in an outer box formed, for example, by a corrugated cardboard or a paperboard are well known. In general, they are formed by using a composite material consisting of, for example, a resin film and paper, and are often used for containing a liquid with a relatively low viscosity such as a beverage or liquid detergent. These containers having a bag each are handled in such a manner that when the contained liquid is taken out of the pouring outlet, air corresponding to the discharged liquid goes into the bag, or they are formed in such a manner that the bag is contracted to allow the contained liquid to be taken out.

A container provided as a bag or a general bag-in carton allows almost all the quantity of the contained liquid to be easily taken out if the liquid has a relatively low viscosity like a beverage or liquid detergent, etc. However, if the contained liquid is a less flowable liquid with a high viscosity such as a printing ink, it can happen that while all the quantity of the contained liquid is discharged, the bag portion near the pouring outlet closes the pouring outlet or the side faces of the bag adhere to each other at a position near the pouring outlet, thereby preventing the stable discharge of the liquid and causing a large quantity of the contained liquid to remain.

To solve the problem, for example, JP6-211273A proposes a bag-in carton having a bag stuck to the inner faces of the carton, in which only a region slightly larger than one half of the bag on the pouring outlet side is stuck and fixed to the inner faces of the carton, and in which when the contained liquid is taken out, the non-fixed portion of the bag moves toward the pouring outlet, and fits in the portion fixed to the inner faces of the carton, so that almost all the quantity of the contained liquid can be taken out.

Furthermore, JP9-150500A proposes a container having a bag-forming container body, a pouring outlet connected to the container body, and an outer box covering the container body, wherein the pouring outlet of the container body is installed at the central bottom of the outer box, and the container body portion around the pouring outlet is bonded to the bottom of the outer box or a support member is provided for preventing the deformation of the container body portion around the pouring outlet, so that almost all the quantity of the contained liquid can be taken out.

Moreover, JP11-165747A proposes a container, in which a bag having a pouring outlet contains a tubular member for preventing the mutual adhesion of the inner faces of the bag when the liquid is sucked, to allow almost all the quantity of the contained liquid to be taken out.

Furthermore, JP11-301693A proposes a container in which a pouring outlet is provided at an end of a bag formed by a flexible resin film, and in which sheets are stuck to the former half of the bag on the pouring outlet side, so that the latter half of the bag can be housed in the former half as the contained liquid is taken out, thereby ensuring that almost all the quantity of the contained liquid can be taken out.

Figure 7:
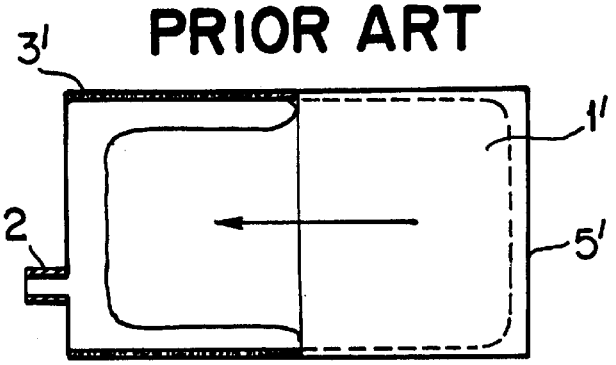
FIG. 7 PRIOR ART

In the conventional methods, as illustrated in FIG. 7, a bag 1' is housed in a carton 5' and the side faces of the bag are bonded to the inner faces of the carton 5' by an adhesive 3' in the region of an almost one half on the pouring outlet

2 side. Therefore, since the bag is folded and shortened as the contained liquid is taken out, the container can conveniently be discarded or separated into the bag 1' and the carton 5' for sorted discharge. However, anyway, the length of the bag 1' can be decreased to only about one half. Furthermore, in the case where the bag 1' is long, the bag 1' is not always smoothly folded.

The object of this invention is to solve the problem of the above conventional flexible containers, by providing a flexible liquid container in which especially the length of the container after use becomes smaller than one half of that before use.

According to this invention, the above object can be achieved by a liquid container, which comprises a container body provided as an elongated flexible bag having a closed end face at an end thereof, a pouring outlet formed at the closed end face of the container body, and a support means for preventing deformation of a side face of the container body in its front portion adjacent to the closed end face, whereby a rear portion of the container body which is not reinforced by the support means is housed into the front portion as the contained liquid is discharged, in which said liquid container further comprises a stopper which is disposed on the side face of the rear portion of the container body for engaging with the front portion of the container body, whereby after the stopper has been engaged with the front portion, portion of the rear portion in front of the stopper is prevented from further housed into the front portion.

The support means can be a member disposed in the container body for reinforcing the container body with a form like a funnel narrowed at the pouring outlet, or an adhesive that bonds the side walls of the container body in the front portion adjacent to the end face to the outer box covering the container body.

In the above support means, "a form like a funnel" generally means a form in which one end is widely opened while the other end is narrowed like a small hole, and is not limited to a form coaxial from one end to the other end as observed with experimental or cooking instruments, but can also be eccentric from one end to the other end as described in the following examples. Furthermore, it is not required that the support member per se is formed like a funnel, as far as the flexible bag is reinforced with a form like a funnel. For the particular constitution of the funnel-like support member, see the specification of Japanese Patent Application No. 2000-10850 and corresponding applications filed in other counties, if necessary.

In this invention, when one stopper is provided, the container body is folded at three positions after use. However, this invention is not limited to this constitution, and a plurality of stoppers spaced from each other in the longitudinal direction of the container body can also be disposed on the side face of the container body in the rear portion thereof, so that it can be folded at five or more positions. In the case where one stopper is provided, if the ratio of the lengths in the longitudinal direction of the container, of the front portion, the portion in front of the stopper in the rear portion and the portion behind the stopper in the rear portion is 1:2 or less:1, it can be prevented that the pouring outlet is closed by the container body folded in the front portion. In this case, the pouring outlet is not required to be provided with an additional closing preventing means.

Thus, according to this invention, as the contained liquid is taken out, the rear portion of the container body is folded at the position of the stopper and housed into the front portion of the container body. So, after use, the container body becomes short in length and less bulky, and thus it can be conveniently discharged as a waste. Even in the case where the length of the container body is long, since it can be reliably folded at the stopper position, the container can be smoothly folded, allowing almost all the quantity of the contained liquid to be taken out.

In this invention, the form of the container body is not especially limited as far as it is an elongated bag, but generally it is a cylindrical, quadrangular or polygonal bag, and it is convenient if a pouring outlet is formed at one of the closed end faces of the bag.

Figure 3:
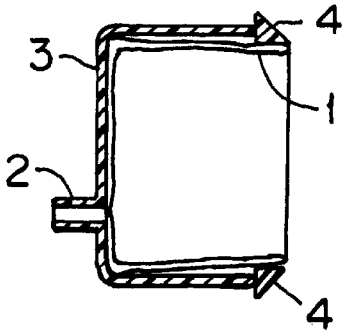
Figure 4:
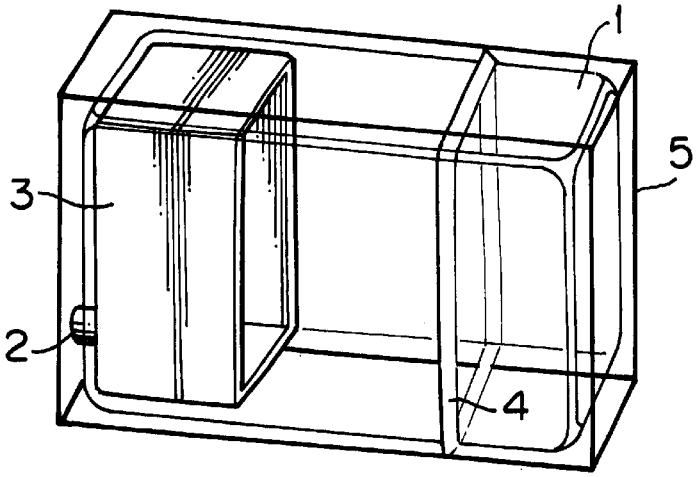
Figure 5:
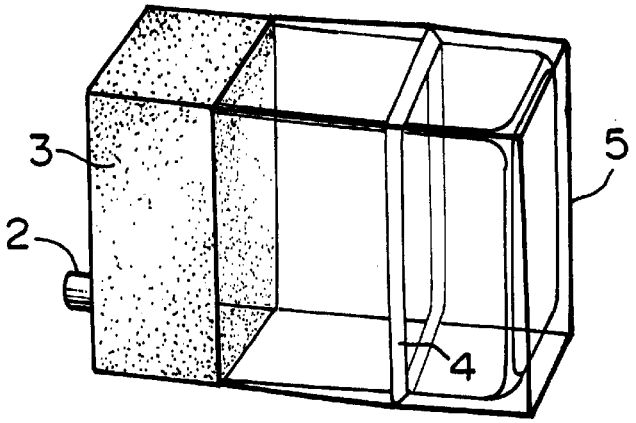
Figure 6:
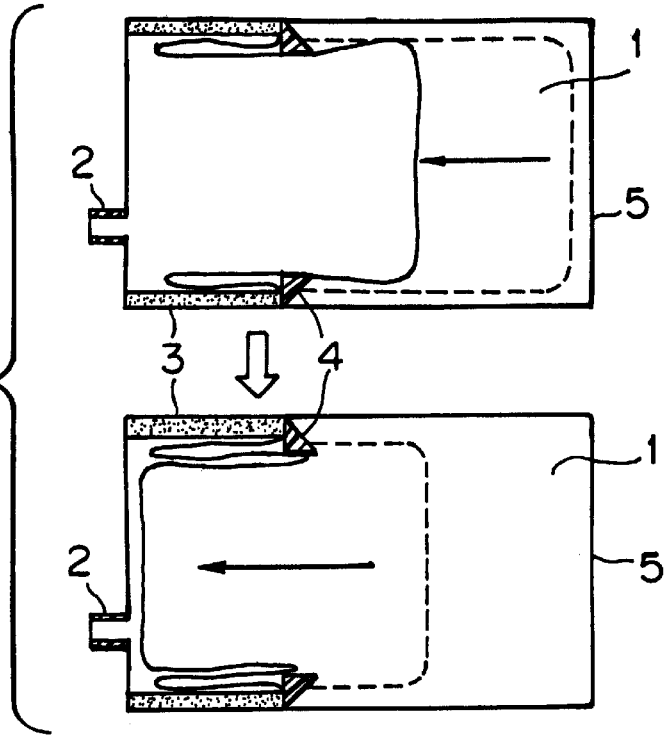

Examples of the liquid container of this invention are described below in reference to FIGS. 1 through 6. The examples in the drawings are illustrative, and this invention is not limited thereto or thereby. In the drawings, FIG. 1 is a schematic perspective view showing an example of the container of this invention, FIG. 2 is a schematic sectional side view of the container of FIG. 1, FIG. 3 is a schematic sectional side view showing the container of FIG. 1 in a state after the contained liquid has been taken out, FIG. 4 is a schematic perspective view showing a modification example of FIG. 1, FIG. 5 is a schematic perspective view showing another example of the container of this invention, FIG. 6 is a schematic sectional side view showing the action of the container of FIG. 5 and FIG. 7 is a schematic sectional side view showing the action of a conventional container.

The container of FIG. 1 has a container body 1 provided as a flexible bag formed by a plastic film. The container body 1 is made to form an almost quadrangular prism when filled with a liquid. The container body 1 is provided at a lower portion of a closed end face with a pouring outlet 2 formed to communicate with the inside of the container body 1 and to protrude outward from the container body 1. Furthermore, the container body 1 is provided internally with a support member 3 disposed adjacently to the end face provided with the pouring outlet 2. The support member 3 has a box form consisting of a rectangular hard end wall adjacent to the end face and side walls extending perpendicularly from the four sides of the end wall along the four side faces of the container body 1, and the pouring outlet 2 is provided through the end wall of the support member 3 and bonded to it, to keep the support member 3 in a predetermined position in the container body. The end wall and side walls of the support means 3 are respectively stuck to the respectively opposing end face and side walls of the container body 1, so that the reinforced front portion of the container body 1 is constituted, and the remaining rear portion is constituted as a flexible rear portion of the container body 1. Thus, the support means 3 has a form like a funnel having the pouring outlet 2 as a narrowed opening and the end surrounded by the side walls on the other side as an expanded opening. Therefore, the front portion of the container body 1 adjacent to the support means 3 is reinforced with a form like a funnel, and is prevented from being deformed, especially from being bent inward due to the inner reduced pressure acting as the contained liquid is taken out. Furthermore, the volumetrically decreased rear portion of the container body 1 can be easily housed in the front portion.

Furthermore, in the rear portion of the container body 1 of FIG. 1, a frame disposed on a plane orthogonal to the longitudinal axial line of the container body 1 is installed as a stopper 4. The frame is installed on the side walls in the rear portion of the container body 1, and is formed to slightly protrude outward from the outer walls formed by the side walls of the container (see FIG. 2). The stopper 4 can be manufactured using the same material as that of the container body 1 such as a plastic material, but can also be formed by folding the bag constituting the container body 1 and fusing the fold to be protruded outward.

Figure 2:
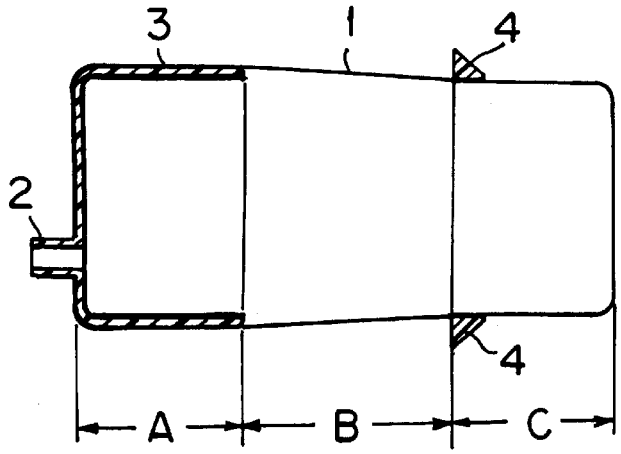

It is preferable that the installation position of the stopper 4 is, as shown in FIG. 2, set as A:B:C=1:2 or less:1 (where A is the length in the longitudinal direction of the front portion of the container body 1; B is the length of the portion in front of the stopper in the rear portion of the container body 1; and C is the length of the portion behind the stopper in the rear portion of the container body 1), since all the quantity of the contained liquid can be easily taken out.

Thus, in the container of FIG. 1, as the contained liquid is taken out of the pouring outlet 2 using, for example, a suction pump, the portion in front of the stopper 4 in the rear portion of the container body 1 is folded in two and housed in the front portion of the container body 1, and after the stopper 4 contacts the edge of the support means 3, the portion behind the stopper in the rear portion of the container body 1 is folded at the position of the stopper 4 and housed in the front portion of the container body 1. Finally as shown in FIG. 3, the rear portion folded back at three positions is housed in the front portion. In this case, if the stopper is set at the position shown in FIG. 2, it does not happen that the pouring outlet 2 is closed by the end face of the housed rear portion before all the quantity of the contained liquid is discharged.

The stopper 4 is not limited to the single stopper described in the above example. Two or more stoppers spaced from each other can be provided in the longitudinal direction of the container body 1 as described before. In this case, it is preferable that the intervals between the stoppers are each set to satisfy the value of said B. Furthermore, the stopper is only required to be able to be engaged with the front portion as the contained liquid is taken out, and is not limited to the illustrated frame. The stopper can also be projections or hooks.

The container of FIG. 1 can also be provided with an outer box 5 for covering the container, with the pouring outlet 2 protruded therethrough as shown in FIG. 4.

In the above, the material of the bag-forming container body is only required to be flexible sufficiently to allow easy manual bending and be able to be sealed. Especially a thin molded body of plastic or plastic resin film is preferable. Cellophane, polyethylene, polypropylene, polyester, nylon, polystyrene, polyvinyl chloride, polyvinylidene chloride, polyvinyl alcohol, polycarbonate, ethylene vinyl alcohol copolymer, fluorine resin, polymethyl methacrylate, polybutene, aluminum foil, any of said resins having a thin oxide film of Si or Al formed thereon, or any of said resins coated with polyvinylidene chloride, ethylene vinyl alcohol copolymer, wax and the like can be used in one layer or multi-layer. However, for the portion of the container body to have its form retained by the support member, since the form of the supported portion may be retained by the strength of the container body per se, the portion is not required to be in a flexible state or to be made of a flexible material.

The material of the support member can be any material as far as it can prevent the volumetric shrinkage and retain the form when the pressure in the container body is reduced. For example, wood, plastic, metal or hard paper can be used. Considering the contained liquid and the disposal as a waste, a plastic material is preferable. This also applies to the material of the pouring outlet.

It is desirable that the support member and the container body are firmly bonded to each other. The adhesives that can be used for bonding include various adhesives such as urea resins, melamine resins, phenol resins, epoxy resins, vinyl acetate resins, acrylic resins, cyanoacrylate adhesives, polyurethane adhesives and EVA. The adhesive type can be adequately selected from dry laminate type, water dry laminate type, non-solvent type, electron radiation curing type, ultraviolet curing type, hot melt type, etc. Especially when the container body and/or the support member is made of a plastic material, any bonding without using any adhesive, such as ultrasonic method or heat seal method, can also be used.

FIG. 5 shows an example in which this invention is applied to a so-called bag-in carbon type container. The container body 1 of FIG. 5 is not provided with the funnel-like member for reinforcing the front portion, and instead, the front portion is stuck to the outer box 5 using an adhesive, and thus is reinforced. In this regard, this container body is different from the container body 1 of FIG. 1. In the rear portion of the container body 1, a stopper 4 similar to that of FIG. 1 is formed. The pouring outlet 2 is protruded outward from the corresponding position of the outer box 5. Thus, the support means 3 of the container body 1 of FIG. 5 is composed of the outer box 5 and the adhesive, and thus the front portion of the container body 1 is reinforced with a form like a funnel as in FIG. 1, to prevent deformation, especially inward bending due to the inner reduced pressure that is caused as the contained liquid is taken out. Furthermore, the volumetrically decreased rear portion of the container body 1 can be easily housed in the front portion. As the adhesive, those stated above in relation with the example of FIG. 1 can be used.

Thus, as shown in FIG. 6, in the container of FIG. 5, as the contained liquid is taken out of the pouring outlet 2 using, for example, a suction pump, at first the portion in front of the stopper 4 in the rear portion of the container body 1 is folded and housed in the front portion of the container body, and after the stopper 4 contacts the edge of the front portion bonded to the outer box, the portion behind the stopper 4 in the rear potion of the container body 1 is folded at the position of the stopper 4 and housed in the front portion of the container body 1. Finally, the rear portion is housed in the front portion, being folded back at three positions. In this case, it is preferable that protrusions (not illustrated) from the inner wall of the outer box 5 toward the container body 1 are provided at the edge of the front portion bonded to the outer box 5, because they assure reliable engagement with the stopper 4.

According to this invention, the front portion on the pouring outlet side of the container body provided as a flexible tubular bag is reinforced by a support means, and the remaining rear portion of the container body is constituted as a flexible portion, to ensure that the flexible rear portion can be housed in the front portion as the contained liquid is taken out. In this container, since a stopper to be engaged with the front portion is provided in the rear portion as a means for limiting the amount of the rear portion entering the front portion at a certain level, the rear portion can be housed in the front portion, being folded with the stopper that provides a folding position. Therefore, the length of the container after use can be decreased to less than one half of that before use, and in addition, even in the case where the length of the container body is long, the rear portion can be well housed in the front portion, and almost all the quantity of the contained liquid can be stably taken out.

What is claimed is:

1. A liquid container, which comprises a container body provided as an elongated flexible bag having a closed end face at an end thereof, a pouring outlet formed at the closed end face of the container body, and a support means for preventing deformation of a side face of the container body in its front portion adjacent to the closed end face, whereby a rear portion of the container body which is not reinforced by the support means is housed into the front portion as the contained liquid is discharged, in which said liquid container further comprises a stopper which is disposed on the side face of the rear portion of the container body for engaging with the front portion of the container body, whereby after the stopper has been engaged with the front portion, portion of the rear portion in front of the stopper is prevented from being further housed into the front portion.

2. A liquid container according to claim 1, wherein said support means is disposed inside the container body and comprises a member which reinforces the container body with a form like a funnel narrowed at the pouring outlet.

3. A liquid container according to claim 2, wherein said container body is provided with an outer box for covering it.

4. A liquid container according to claim 1, wherein said container body is provided with an outer box for covering it, and said support means is composed of a bonded portion where the side faces of the container body in the front portion adjacent to the end face is bonded to the outer box.

5. A liquid container according to any one of claims 1 through 4, wherein said container comprises a plurality of said stoppers, the stoppers being spaced from each other in a longitudinal direction of the container body and disposed on the side face of the rear portion of the container body.

6. A liquid container according to any one of claims 1 through 4, wherein said container comprises a single stopper disposed on the side face of the rear portion of the container body, and the ratio of the lengths in a longitudinal direction of the container, of the front portion, the portion in front of the stopper in the rear portion and the portion behind the stopper in the rear portion is 1:2 or less:1.

* * * * *